United States Patent [19]

Berg et al.

[11] 4,263,108

[45] Apr. 21, 1981

[54] CONTROL SYSTEM FOR THE ELECTROLYTIC RECOVERY OF SILVER FROM PHOTOGRAPHIC FIXING SOLUTION

[75] Inventors: Bernard J. Berg, Kentwood; Darrell T. Thompson, Grandville, both of Mich.

[73] Assignee: Foresight Enterprises, Incorporated, Grand Rapids, Mich.

[21] Appl. No.: 134,197

[22] Filed: Mar. 27, 1980

[51] Int. Cl.[3] ..... C25C 1/22

[52] U.S. Cl. ..... 204/109

[58] Field of Search ..... 204/109

[56] References Cited

U.S. PATENT DOCUMENTS

| | | | |
|---|---|---|---|
| 3,751,355 | 8/1973 | Mandroian | 204/109 |
| 3,875,032 | 4/1975 | Thompson | 204/109 |
| 4,018,658 | 4/1977 | Alfin et al. | 204/109 |

*Primary Examiner*—R. L. Andrews

*Attorney, Agent, or Firm*—Glenn B. Morse

[57] ABSTRACT

Plating current in a silver-recovery process is controlled as a function of the cell voltage of the system taken in the absence of plating current, and held as a control determinant. The control is modified to produce certain characteristics at low silver concentration to further reduce sulfiding.

5 Claims, 4 Drawing Figures

CONTROL SYSTEM FOR THE ELECTROLYTIC RECOVERY OF SILVER FROM PHOTOGRAPHIC FIXING SOLUTION

BACKGROUND OF THE INVENTION

Subjecting exposed photographic film to a "fixing" solution removes the silver in the film that has not been converted by exposure to light and the subsequent development process. This silver accumulates in the solution, and is removed both to maintain the activity of the solution, and to recover the value of the silver. The common recovery process is based on electrolysis, and is similar to electroplating. The process must be carefully controlled to prevent some of the plating current from involving the thiosulfate ions present in the solution, and contaminating the deposited silver with a silver sulfide. This is usually accompanied by the objectionable release of hydrogen sulfide gas.

Several arrangements have been devised to control the plating current with enough precision that excesses do not develop beyond the carrying capacity of the silver concentration in the solution. Obviously, the plate-out procedure progressively decreases this concentration. In addition, a number of other variables have pronounced effects on the carrying capacity of the solution. These include temperature, solution level, and electrode area, in addition to the variables introduced by the control system itself. The principles on which control is based have included control as a function of the following:

(a) The color of the deposited silver.
(b) Voltage change as plating proceeds.
(c) Independent voltage-monitoring by sensor.
(d) Threshold voltage required to pass a current through the solution, and the current induced by this threshold voltage (with an independent detector circuit).
(e) Measurement of decay time, in which current is removed after a known voltage has been suppressed for a particular period. The residual cell voltage is monitored for a fixed period of time.

United States Patents illustrative of some of the above approaches include U.S. Pat. Nos. 3,551,318; 3,751,355; and 3,875,032. The British Pat. No. 1,144,756 (1969) has also been noted.

All of these systems appear to have characteristic problems associated with them. Where the system assumes a known voltage versus current relationship for varying silver concentration, the temperature dependency of the fixing solution is usually not accounted for. Solution levels, cathode area, and anode area are critical. Monitoring of current in a DC path is difficult at high plating currents, to the necessary accuracy. Electrical connection voltage drops are also critical, and are difficult to control, especially so in cases where disengageable connections are used in portions of the circuitry. Additionally, the plating process causes increased cathode surface area, changing the plating characteristic in the positive feedback manner. Where rotating cathode or anode are used in a system, the resulting commutation voltage drops present an additional unpredictable variable. Where a separate sensor is used to detect the concentration of the solution, and monitor the plating voltage accordingly, temperature dependency is also usually not accounted for. The surface of the sensor must be cleaned regularly to remove deposited silver, or sulfiding occurs. Other contaminants on the sensor surfaces also have the effect of reducing surface area, causing wasted silver due to reduced sensor currents at a fixed silver concentration level. Beyond this, the sensor system itself is an additional cost factor. In systems based upon the measurement of decay time, it has been found that the configuration has poor anti-sulfide characteristics in the low-current state. Temperature compensation is also not usually applied, and the recovery of silver is not continuous. The high current state in this system can also occur in a sulfiding condition. These problems have resulted in the development of the present invention.

SUMMARY OF THE INVENTION

The present invention establishes control of the plating current as a function of the cathode-anode voltage of the solution at a time when plating curent is zero, thus giving the electrolytic cell current of the solution at its particular condition of concentration. The primary electrodes thus additionally function as a sensor, with this signal being used with a sample-hold circuit. The control in response to this signal is also modified with a shaping amplifier to produce desired characteristics at low concentration to minimize sulfiding effects.

DESCRIPTION OF THE PREFERRED EMBODIMENT

Figure 1:
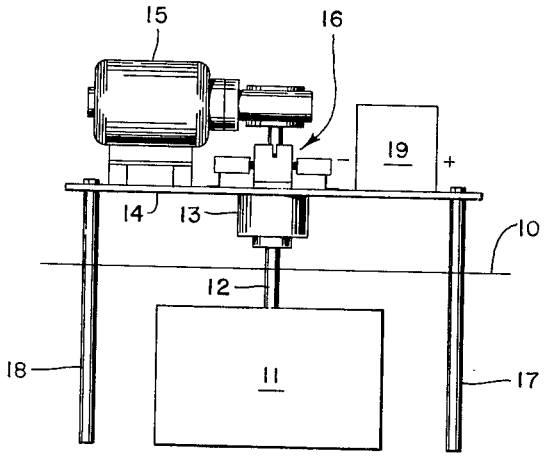
FIG. 1 is a schematic view showing a recovery electrode system involving a rotatable drum-shaped cathode.

FIG. 1 illustrates a unit intended for installation in any convenient tank of solution, the resulting liquid level being preferably established as indicated at 10. Wiring and other electrical connections are eliminated from FIG. 1 for clarity. The rotating drum cathode 11 is supported on the shaft 12 received in the bearing 13 secured to the base plate 14. The shaft 12 extends upward through the plate 14 to a point of interengagement with the gearmotor 15 for slow continuing rotation of the cathode drum 11. A brush commutator assembly 16 provides electrical connection to the cathode drum 11 during the rotation of the shaft 12. The anodes 17 and 18 are also secured to the base plate 14, and cooperate with the cathode 11 to provide the electrolytic circuit in the tank. The power supply unit is indicated schematically at 19, and is shown in detain in FIG. 2. During the operation of the device, silver is desposited on the cathode drum 11, and is periodically removed.

Figure 2:
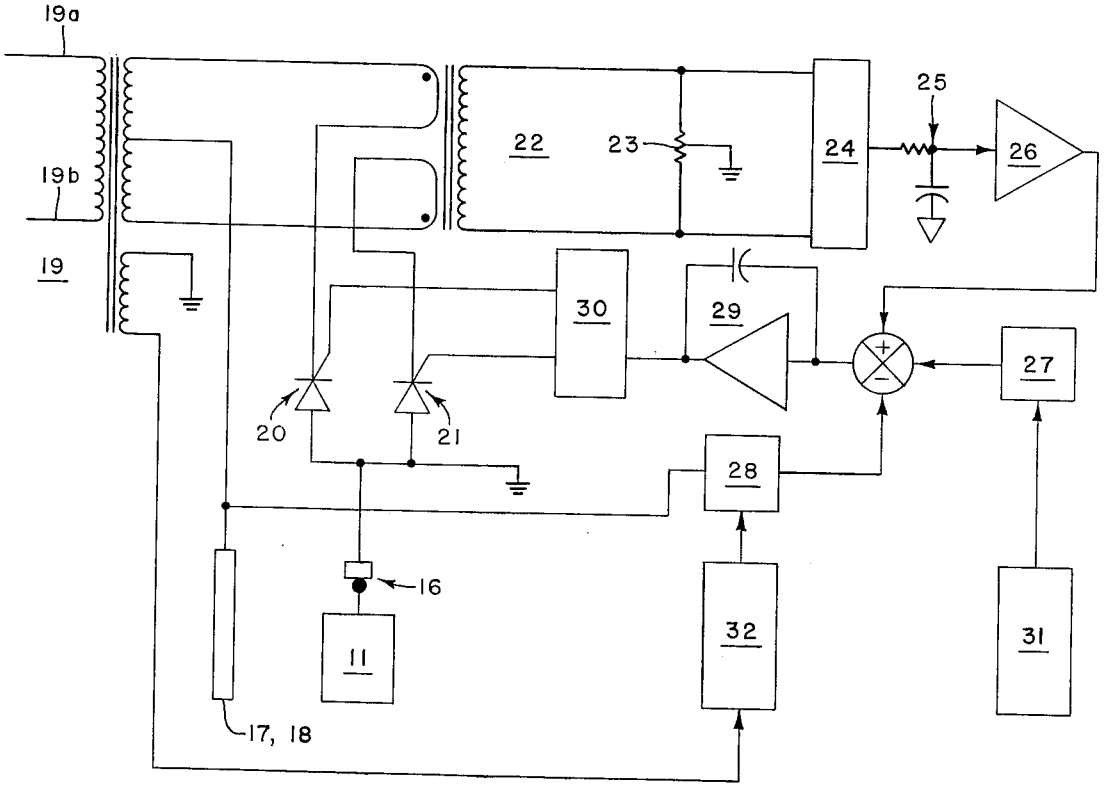
FIG. 2 is a circuit diagram showing the system for controlling the plating current according to the present invention.

Referring to FIG. 2, the power source for the circuit is the center-tapped transformer 19 receiving power initially through the leads **19*a* and 19*b*. The output of this transformer is supplied to the pair of SCR rectifiers 20 and 21, and this driving current is continuously monitored by the current-sampling transformer 22, the output of which is applied across the sampling resistance 23. This produces a precise voltage feedback reference proportional to recovery current flowing between the cathode and anodes. This voltage is full-wave demodulated by the conventional demodulator 24, and then filtered by the standard filter arrangement 25. This output is fed to the shaping amplifier 26**, whose characteristics shape the response of the cathode voltage with respect to the sensed current to modify the response to the system during the existence of a low concentration of silver ions within the solution in the tank.

The output of the shaping amplifier 26, combined with a reference voltage 27, is balanced by the feedback signal from the sample-hold circuit 28. The intergrator 29 stabilizes the loop, and controls the SCR drive phase-shift control 30. The reference voltage 27 is made to be temperature dependent by the temperature sensor 31. These devices are standard circuit components.

Figure 3:
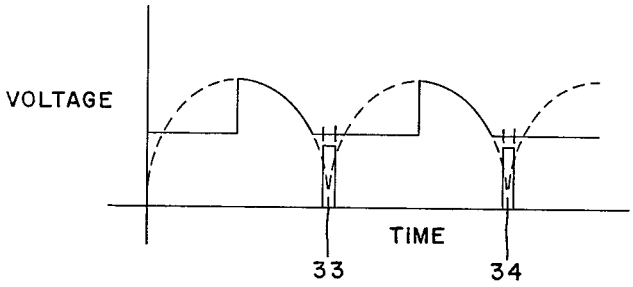
FIG. 3 is a graph showing the selection of pulses by the sample-hold circuit for uses as a control determinant.
Figure 4:
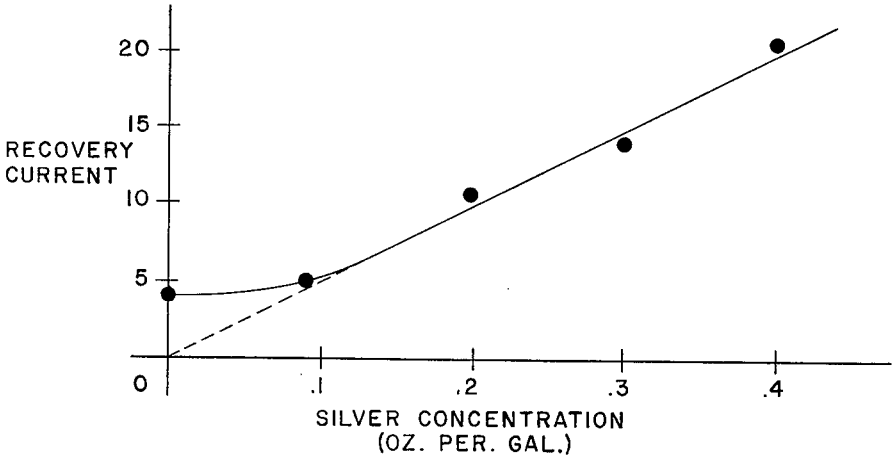
FIG. 4 is a graph showing the relationship between recovery current and silver concentration with and without a shaping amplifier.

The sample-hold unit 28 provides a feedback arrangement that detects the residual cell voltage on the cathode 11 with respect to the anodes 17–18 at a time when the SCR devices 20 and 21 are not carrying current. This is accomplished by a zero-crossing detector 32, which puts out a sampling pulse at a time when the voltage from the transformer 19 is zero. This voltage is closely related to the concentration of silver ions, as the cathode-anode system is then functioning like a battery. This condition is illustrated in FIG. 3 at the pulse bands 33 and 34. Using the primary cathode-anode system (11, 17, 18) in this way as a detector to provide the principal determinant for controlling the recovery current, FIG. 4 illustrates in full-line the relationship between silver concentration and recovery current that is produced without the presence of the shaping amplifier 26. To further reduce the sulfiding characteristics of the system, the shaping amplifier is incorporated to produce a continuation of a straight-line portion of the curve along the dotted line, as indicated.

A triac system can be used to phase-delay control with the same SCR drive. A positive pulse to the gate (with respect to the main terminal) will turn the triac "on", and it will turn off on zero current. This provides an equivalent phase-delay control to the illustrated SCR drive circuit.

We claim:

1. A method fo controlling the plating current of an electrolytic silver-recovery process including placing cathode and anode elements in a solution containing silver ions, and applying a current through said solution via said elements as a function of the concentration of silver ions in said solution, wherein the improvement comprises:

repeatedly sampling the residual cell voltage in said solution at periods when the exterior applied voltage is substantially zero, and obtaining a voltage pulse under this condition; and controlling said current as a function of said pulses.

2. A method as defined in claim 1, including the combination of said pulses with a feedback signal related directly to the voltage applied across said anode and cathode elements.

3. A method as defined in claim 2, wherein said pulses and feedback signal are additionally combined with a reference voltage modified as a function of temperature.

4. A method as defined in claim 1, wherein the control of said current as a function of said pulses is modified at low pulse intensity to decrease the applied current to produce a substantially constant relationship between current and silver concentration.

5. A method as defined in claim 1, wherein said residual cell voltage is taken via said cathode and anode elements.

* * * * *